United States Patent [19]

Luke et al.

[11] 4,135,523

[45] Jan. 23, 1979

[54] TOBACCO-SMOKE FILTERS

[75] Inventors: John A. Luke, Romsey; Fred Haslam, Southampton, both of England

[73] Assignee: British-American Tobacco Company Limited, London, England

[21] Appl. No.: 776,774

[22] Filed: Mar. 11, 1977

[30] Foreign Application Priority Data

Mar. 17, 1976 [GB] United Kingdom ..... 10766/76

[51] Int. Cl.[2] ..... A24B 15/02

[52] U.S. Cl. ..... 131/261 B; 131/10.5; 131/209

[58] Field of Search ..... 131/10 R, 11, 10.3, 131/10.7, 10 A, 261 R, 261 B, 269, 10.5

[56] References Cited

U.S. PATENT DOCUMENTS

| | | | |
|---|---|---|---|
| 3,336,928 | 8/1967 | Morehouse | 131/10.5 |
| 3,964,493 | 6/1976 | Baker | 131/10.5 |
| 4,033,362 | 7/1977 | Almqvist | 131/10 A |

*Primary Examiner*—Robert W. Michell

*Assistant Examiner*—V. Millin

*Attorney, Agent, or Firm*—Kane, Dalsimer, Kane, Sullivan & Kurucz

[57] ABSTRACT

A filter element for a smoking article, such as a cigarette, comprises a generally cylindrical body having at least one helical groove in its peripheral surface and closely wrapped in a material pervious to vapor-phase constituents of the smoke, whereby such constituents are removed by diffusion thereof through said material during passage of the smoke along the groove. The body may be wholly or in part of a filter material capable of removing particulate-phase constituents from the smoke during its passage through the element. Suitably the groove extends from the upstream end face of the body to a point short of the downstream end face, where it opens into a space separated from the downstream end by an ungrooved portion of smoke-filter material. One or more faces of the groove and/or said upstream end face may be partially or wholly sealed against penetration of smoke into the body.

7 Claims, 1 Drawing Figure

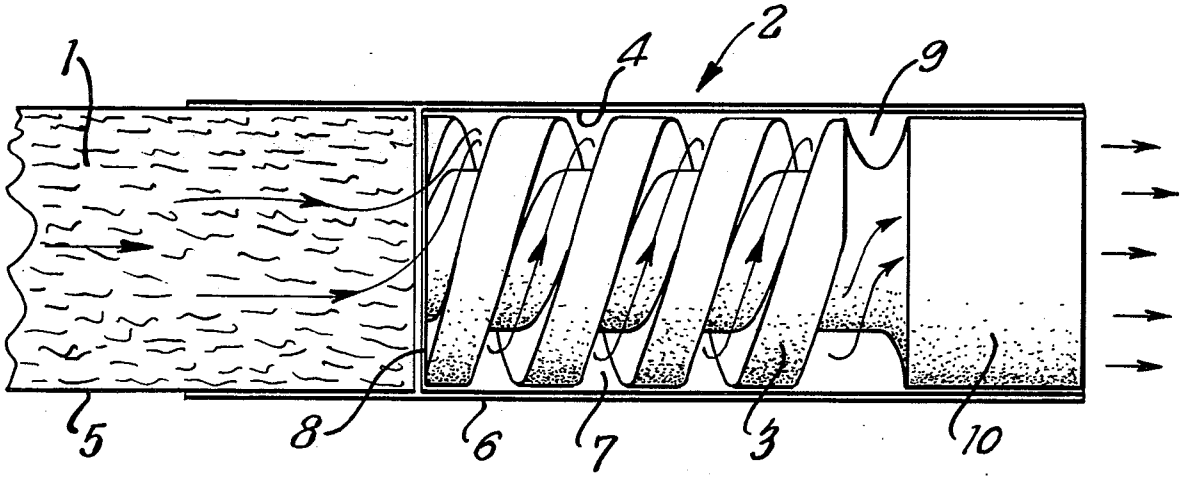
1
2
3
4
5
6
7
8
9
10

TOBACCO-SMOKE FILTERS

This invention concerns improvements relating to filters for smoking-articles, particularly but not exclusively tobacco-smoke filters for cigarettes. It seeks to provide a filter by which high reductions of smoke constituents of lower molecular weight, for example and particularly carbon monoxide, as well as reductions of particulate-phase constituents, that is heavier constituents such as tars, can be achieved by simple, practical, means.

According to the invention, a smoking-article filter element comprises a generally cylindrical body which has at least one helical groove in its peripheral surface and is closely wrapped in a material pervious to vapour-phase constituents of the smoke, whereby vapour-phase constituents are removed by diffusion thereof through said wrapping material during passage of the smoke along the groove or grooves. By the use of such a filter element, the delivery of smoke constituents of lower molecular weight is very materially reduced due to outward diffusion thereof from the groove or grooves through the wrapping material, for example paper. At the same time, the delivery of heavier constituents is also substantially reduced due to the effect, upon the combustion process, of inward penetration of air through the wrapping material into the groove or grooves.

Advantageously, the body is made wholly or in part of a filter material capable of removing particulate-phase constituents from the smoke during its passage through the filter element. In this case, removal of the heavier constituents may be increased by passage of the smoke through part of the body made of the filter material. Removal of lighter constituents may also be enhanced.

Preferably, the groove or grooves extend from the upstream end face of the body to a point short of the downstream end face thereof. They may terminate in or open at the downstream end thereof into a face located in the body short of its downstream end face, for example an annular groove in the said body. Advantageously, the said space is then separated from the downstream end face of the body by an ungrooved end portion, made of smoke-filter material, of the body. With this form of element, as the smoke passes along its length, filtration will occur in two main stages: Firstly, as the smoke passes along the helical groove or grooves, lighter smoke constituents, for example carbon monoxide, will diffuse outwardly through the wrapping material, while air will penetrate inwardly. Secondly, the smoke will then pass from the aforesaid space and through the said ungrooved portion, made for example of cellulose acetate or other thermoplastic filter material or of paper, by which particulate-phase constituents are removed.

The aforesaid body, prior to being grooved, may or may not be wrapped in known manner, but the external wrapping material already referred to is not grooved. The external wrapping material or, it a tipping material is also provided, the combination of external wrapping material and tipping material must be of such porosity that outward diffusion can take place from the groove or grooves into the atmosphere. In some cases, there may also be diffusion into the body. Suitable porosity ranges for the said external wrapping material or the combination of that material and tipping material, if used, are, broadly, between 500 and 15,000 cc/min/10cm$^2$/10cm W.G.

BRIEF DESCRIPTION OF THE DRAWING

The FIGURE of the drawing is a fragmentary diagrammatic view of a filter cigarette with some elements partly removed and arrows showing the direction of smoke flow.

DETAILED DESCRIPTION

One embodiment of the invention will now be described, by way of example, with reference to the accompanying diagrammatic drawing, which shows part of a filter cigarette with some elements partly removed.

The cigarette comprises a rod of tobacco 1 and a filter 2. The filter 2 comprises a generally cylindrical element 3, or plug body, of cellulose acetate, which element 3 is closely wrapped in a porous paper wrap 4. The tobacco rod 1 is wrapped in cigarette paper 5, and the rod 1 and filter 2 are connected together by a porous tipping band 6. The latter band need not extend for the full length of the element 3 as illustrated or it may be omitted, in which case a short band serving simply to connect the wrapped rod 1 to the wrapped filter element 3 may be provided.

A square-section helical groove 7 extends at the peripheral surface of the element 3 from the tobacco-end end face 8 of the element, over a major portion of the length of the element, to an annular groove 9, that is a groove in a plane normal to the axis of the element. The remaining portion 10 of the element 3 is of ungrooved regular cylindrical form.

When the cigarette is smoked, tobacco smoke from the tobacco rod 1 passes (as indicated by arrows in the drawing) along the helical groove 7 into the groove 9, which acts as a smoke-distribution groove, and thence through the portion 10 of the filter element 3. During smoking, as the smoke passes along the groove 7, smoke constituents of lower molecular weight, for example carbon monoxide, will diffuse outwardly through the wrap 4 and the tipping band 6, while air penetrates inwardly. As the smoke subsequently passes through the portion 10 of the element 3 particulate-phase constituents of the smoke, i.e. heavier constituents such as tars, are removed.

Generally, in this embodiment of the invention, the face 8 of the element 3 and the faces of the groove 7 will not be sealed, that is of reduced previousness to smoke. A small proportion of the smoke stream will pass into the element 3 upstream of the portion 10, this also resulting in removal of particulate-phase constituents and a small proportion of the constituents of lower molecular weight. If the said faces are sealed at all, they should not be more than partially sealed.

Instead of the flat end face 8, the filter element 3 may have a conical end with the apex pointing upstream. In this case, the end may be at least partially sealed. Such conical shape and or sealing may serve to guide the smoke into the helical groove.

More than one helical groove may be provided after the fashion, say, of a two-start screw-thread.

Filter materials other than cellulose acetate, for example another thermoplastic filter material or paper, may be used for the element 3. Particulate carbon or other adsorbent material may be incorporated in the material of the filter element.

A grooved filter element such as the element 3 may be produced, for example, by the method described and claimed in the Specification of the co-pending application Ser. No. 776,522 of even date, that is by feeding a cylindrical rod of the filter material in a direction transverse to its length past a heated projecting member or members by which grooves are formed in the rod, which is meanwhile turned about its axis, under the effect of heat and pressure. For a helical groove, such as 7, the forming member will be located at an angle to the rod and no relative axial movement occurs between the rod and the forming member. An annular groove, such as 9, is formed by a second forming member. If a partial or complete surface-sealing effect is required, the heating of the part or parts of the forming member producing the face or faces to be sealed may be made such as to bring the filter material locally to a temperature sufficient to produce superficial fusion thereof and partial or complete sealing at the said face of faces, as required.

Tests have been carried out which illustrate reductions of CO and total particulate material (T.P.M.) which have been obtained. For the purposes of the tests, a cylindrical filter element 20mm long was used having in its peripheral surface, over its whole length, a helical groove of square section, substantially as shown in the drawing, but without the end portion 10 and without the tipping band 6, the object being to illustrate the effects of the helical groove 7 and porous wrap 4 alone. The groove had a width of 3mm and a pitch of 6mm. The pitch angle was thus about 10°.

The tests were divided into three groups:

GROUP I

The cylindrical elements, formed of cellulose acetate, were wrapped in a number of papers of different porosity values, some of which were naturally porous paper and other electrostatically perforated paper.

Tobacco smoke was drawn through each wrapped element from a rod of tobacco smoked under standard conditions, i.e. one puff per minute of 35 $cm^3$ volume and two seconds duration. A comparable cigarette, but having no filter, was smoked under the same conditions as a test control. The results of the Group I test are shown in Table I. As for all Groups, porosities are in units of $cm^3/10\ cm^2$ of air flow/ 100mm Water Gauge/-minute:

Table I

| Paper Porosity | | CO Reduction (%) by weight | T.P.M. Reduction (%) by weight |
|---|---|---|---|
| Naturally porous | 1,000 | 20 | 39 |
| | 5,000 | 46 | 56 |
| Electrostatically Perforated | 1,200 | 52 | 64 |
| | 3.000 | 58 | 70 |
| | 10,000 | 78 | 86 |

GROUP II

The Group II tests were identical with the first two tests of Group I except that the tobacco-end faces 8 of the cellulose acetate elements were partially sealed by applying thereto a solution of cellulose acetate in acetone. The results of these tests are given in Table II.

Table II

| Paper Porosity | | CO Reduction (%) by weight | T.P.M. Reduction (%) by weight |
|---|---|---|---|
| Naturally porous | 1,000 | 21 | 42 |

Table II-continued

| Paper Porosity | | CO Reduction (%) by weight | T.P.M. Reduction (%) by weight |
|---|---|---|---|
| | 5,000 | 41 | 54 |

GROUP III

In order to obtain results for elements having the end faces 8 and the faces of the helical grooves 7 totally impervious to tobacco smoke, tests were made corresponding to those of Group I but with elements formed of 'Perspex' (Trade Mark). The results are given in Table III:

Table III

| Paper Porosity | | CO Reduction (%) by weight | T.P.M. Reduction (%) by weight |
|---|---|---|---|
| Naturally porous | 1,000 | 19 | 23 |
| | 5,000 | 39 | 38 |
| Electrostatically Perforated | 1,200 | 35 | 56 |
| | 3,000 | 44 | 62 |
| | 10,000 | 65 | 66 |

As the results set out in the three tables show, the carbon monoxide reductions increased as the porosity value of the paper increases. Electrostatically perforated papers gave higher levels of carbon-monoxide reduction than did naturally porous papers. These observations also hold good in regard to the levels of reduction of total particulate matter.

Referring to Tables I and II, very good CO and T.P.M. reductions were obtained with electrostatically perforated paper having a porosity value of 10,000. Even better CO and T.P.M. reductions might result from using papers with yet higher porosity values, but the law of diminishing returns would apply. Also at very high porosity values, it might be difficult or impossible to maintain the burning of a cigarette.

Comparing the results of Table II with those of Table I, it can be seen that the partial sealing of the tobacco-end faces of the cellulose acetate elements had a minimal effect upon the CO and T.P.M. reductions. However, a comparison of the results of Table III with those of Table I shows, especially in regard to the electrostatically perforated paper, that total sealing of the end faces 8 and grooves of the elements led to significantly lower reductions of CO and T.P.M.

We claim:

1. A smoking-article filter element comprising a body of fibrous filter material offering a filter surface which has at least one helical groove in its peripheral surface and is closely wrapped in a material pervious to vapor-phase constituents of the smoke, whereby vapor-phase constituents are removed by diffusion thereof through said wrapping material during passage of the smoke along the said helical groove, while particulate-phase constituents are removed mechanically from the smoke passage through the said body at least a portion thereof removed by passage of smoke through the part of the body other than the groove.

2. A filter element according to claim 1 wherein the said helical groove terminates short of the downstream end of the element where filter material for particulate phase constituents is disposed for receiving smoke issuing from the said grooves.

3. A filter element according to claim 1 wherein the said helical groove opens at the downstream end thereof into a space located in the body short of its downstream end face.

4. A filter element according to claim 3 wherein the said space is a peripheral annular groove formed in the body.

5. A filter element according to claim 3 wherein the space is separated from the downstream end of the body by an ungrooved end portion, made of smoke-filter material, of the body.

6. A filter element according to claim 1 wherein at least one face bounding the said helical groove in the body is at least partially sealed against penetration of smoke from the groove into the body.

7. A filter element according to claim 1 wherein the upstream end face of the body is at least partially sealed against the penetration of smoke into the body.

* * * * *

UNITED STATES PATENT OFFICE

CERTIFICATE OF CORRECTION

PATENT NO. : 4,135,523

DATED : January 23, 1979

INVENTOR(S) : John A. Luke & Fred Haslam

It is certified that error appears in the above-identified patent and that said Letters Patent are hereby corrected as shown below:

Col. 1, line 41, before "located" the word "face" should read --space--;

Col. 1, line 61, after "or," the word "it" should read --if--;

Col. 4, line 62, after "smoke" the word --during-- should be inserted;

Col. 5, line 11, before the word "space" the word --said-- should be inserted.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*